US009390901B2

(12) United States Patent
Kertesz et al.

(10) Patent No.: US 9,390,901 B2
(45) Date of Patent: Jul. 12, 2016

(54) SYSTEM AND METHOD FOR LIQUID EXTRACTION ELECTROSPRAY-ASSISTED SAMPLE TRANSFER TO SOLUTION FOR CHEMICAL ANALYSIS

(71) Applicant: UT-Battelle, LLC, Oak Ridge, TN (US)

(72) Inventors: Vilmos Kertesz, Knoxville, TN (US); Gary J. Van Berkel, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 14/529,307

(22) Filed: Oct. 31, 2014

(65) Prior Publication Data

US 2016/0126080 A1 May 5, 2016

(51) Int. Cl.

*H01J 49/04* (2006.01)
*H01J 49/16* (2006.01)
*H01J 49/26* (2006.01)

(52) U.S. Cl.

CPC ..... *H01J 49/167* (2013.01); *H01J 49/04* (2013.01); *H01J 49/0431* (2013.01); *H01J 49/26* (2013.01)

(58) Field of Classification Search

CPC ..... H01J 49/16; H01J 49/26; H01J 49/168; H01J 49/0027; H01J 49/165; H01J 49/04; H01J 49/0431

See application file for complete search history.

(56) References Cited

U.S. PATENT DOCUMENTS 5,208,458 A * 5/1993 Busch ..... H01J 49/04 250/281
5,663,561 A * 9/1997 Franzen ..... H01J 49/145 250/282
6,803,566 B2 10/2004 Van Berkel
7,462,824 B2 * 12/2008 Wang ..... H01J 49/0463 250/281
8,084,735 B2 12/2011 Kertesz et al.
8,097,845 B2 * 1/2012 Roach ..... H01J 49/0404 250/288
8,232,520 B2 * 7/2012 Cristoni ..... H01J 49/04 250/281
8,324,570 B2 * 12/2012 Wiseman ..... H01J 49/0459 250/288
8,384,020 B2 * 2/2013 Jesse ..... H01J 49/0004 250/281
8,486,703 B2 7/2013 Van Berkel et al.
8,497,473 B2 7/2013 Kertesz et al.

(Continued)

OTHER PUBLICATIONS

Kertesz et al., "Automated liquid microjunction surface sampling—HPLC-MS/MS analysis of drugs and metabolites in whole-body thin tissue sections", Bioanal. (2013) 5(7): 819-826, March.

(Continued)

*Primary Examiner* — Wyatt Stoffa
(74) *Attorney, Agent, or Firm* — Fox Rothschild LLP

(57) ABSTRACT

A system for sampling a surface includes a surface sampling probe comprising a solvent liquid supply conduit and a distal end, and a sample collector for suspending a sample collection liquid adjacent to the distal end of the probe. A first electrode provides a first voltage to solvent liquid at the distal end of the probe. The first voltage produces a field sufficient to generate electrospray plume at the distal end of the probe. A second electrode provides a second voltage and is positioned to produce a plume-directing field sufficient to direct the electrospray droplets and ions to the suspended sample collection liquid. The second voltage is less than the first voltage in absolute value. A voltage supply system supplies the voltages to the first electrode and the second electrode. The first electrode can apply the first voltage directly to the solvent liquid. A method for sampling for a surface is also disclosed.

28 Claims, 8 Drawing Sheets

(56) References Cited

U.S. PATENT DOCUMENTS

| | | | | |
|---|---|---|---|---|
| 8,519,330 | B2 | 8/2013 | Van Berkel et al. | |
| 8,637,813 | B2 | 1/2014 | Van Berkel et al. | |
| 8,710,436 | B2 | 4/2014 | Otsuka | |
| 8,742,338 | B2 | 6/2014 | Van Berkel et al. | |
| 9,064,680 | B2 * | 6/2015 | Van Berkel | G01Q 30/14 |
| 2006/0108539 | A1 * | 5/2006 | Franzen | H01J 49/165 250/423 P |
| 2008/0128614 | A1 * | 6/2008 | Nikolaev | H01J 49/165 250/288 |
| 2008/0156985 | A1 * | 7/2008 | Venter | H01J 49/165 250/288 |
| 2008/0272294 | A1 * | 11/2008 | Kovtoun | H01J 49/0463 250/288 |
| 2009/0140137 | A1 * | 6/2009 | Hiraoka | H01J 49/165 250/282 |
| 2011/0284735 | A1 | 11/2011 | Van Berkel et al. | |
| 2012/0053065 | A1 | 3/2012 | Van Berkel et al. | |
| 2012/0079894 | A1 * | 4/2012 | Van Berkel | H01J 49/0463 73/863.11 |
| 2012/0304747 | A1 | 12/2012 | Van Berkel et al. | |
| 2013/0294971 | A1 | 11/2013 | Van Berkel et al. | |
| 2013/0330714 | A1 * | 12/2013 | Cooks | C12Q 1/04 435/5 |
| 2013/0334030 | A1 * | 12/2013 | Otsuka | H01J 49/165 204/164 |
| 2013/0341279 | A1 * | 12/2013 | Otsuka | B01D 59/44 210/663 |
| 2014/0070089 | A1 * | 3/2014 | Otsuka | H01J 49/168 250/282 |
| 2014/0070093 | A1 * | 3/2014 | Otsuka | H01J 49/16 250/288 |
| 2014/0070094 | A1 * | 3/2014 | Otsuka | H01J 49/16 250/288 |
| 2014/0072476 | A1 * | 3/2014 | Otsuka | H01J 49/0454 422/83 |
| 2014/0096624 | A1 | 4/2014 | Elnaggar | |
| 2014/0216177 | A1 | 8/2014 | Van Berkel et al. | |
| 2014/0238155 | A1 | 8/2014 | Van Berkel et al. | |
| 2015/0034817 | A1 * | 2/2015 | Otsuka | H01J 49/10 250/282 |

OTHER PUBLICATIONS

Kertesz et al., "Liquid microjunction surface sampling coupled with high-pressure liquid chromatography-electrospray ionization-mass spectrometry for analysis of drugs and metabolites in whole-body thin tissue sections", Anal. Chem. (2010) 82: 5917-5921.

Lorenz et al., "Controlled-Resonant Surface Tapping-Mode Scanning Probe Electrospray Ionization Mass Spectrometry Imaging", Anal. Chem. (2014), 86 (6): 3146-3152, March.

Otsuka et al., "Imaging mass spectrometry of a mouse brain by tapping-mode scanning probe electrospray ionization", Analyst (2014) 139: 2336-2341, Feb.

Otsuka et al., "Scanning probe electrospray ionization for ambient mass spectrometry", Rapid Commun. Mass Spectrom. (2012) 26: 2725-2732.

Ovchinnikova et al., "Combining Laser Ablation/Liquid Phase Collection Surface Sampling and High-Performance Liquid Chromatography Electrospray Ionization Mass Spectrometry", Anal. Chem. (2011) 83: 1874-1878. (abstract only).

Rao et al., "Ambient DESI and LESA-MS analysis of proteins adsorbed to a biomaterial surface using in-situ surface tryptic digestion", J. Am. Soc. Mass Spectrom. (2013) 24: 1927, Sep.

Roach et al., "Nanospray desorption electrospray ionization: An ambient method for liquid-extraction surface sampling in mass spectrometry", Analyst (2010) 135: 2233-2236.

Van Berkel et al., "Continuous-flow liquid microjunction surface sampling probe connected on-line with high-performance liquid chromatography/mass spectrometry for spatially resolved analysis of small molecules and proteins", Rapid Commun. Mass Spectrom. (2013) 27: 1329-1334, March.

* cited by examiner

SYSTEM AND METHOD FOR LIQUID EXTRACTION ELECTROSPRAY-ASSISTED SAMPLE TRANSFER TO SOLUTION FOR CHEMICAL ANALYSIS

STATEMENT REGARDING FEDERALLY SPONSORED RESEARCH

This invention was made with government support under contract No. DE-AC05-00OR22725 awarded by the U.S. Department of Energy. The government has certain rights in this invention.

FIELD OF THE INVENTION

This invention relates to chemical analysis, and more particularly to liquid extraction surface sampling for chemical analysis.

BACKGROUND OF THE INVENTION

The field of chemical analysis has been assisted by the use of liquid extraction surface sampling. Liquid extraction-based surface sampling mass spectrometry (MS) employing spatially resolved confined liquid/solid extraction of the analyte(s) of interest from a surface is becoming an established analysis methodology. The increased use of this methodology is due in part to the realization that this sampling method provides unrivaled sensitivity compared to other ambient surface sampling techniques. Examples of such systems are shown in U.S. Pat. No. 8,084,735 to Kertesz et al; U.S. Pat. No. 8,384,020 to Jesse et al.; U.S. Pat. No. 8,486,703 to Van Berkel et al.; U.S. Pat. No. 8,637,813 to Van Berkel et al.; U.S. Pat. No. 8,519,330 to Van Berkel et al.; U.S. Pat. No. 8,497,473 to Kertesz et al.; U.S. Pat. No. 8,742,338 to Van Berkel et al.; and U.S. Pat. No. 6,803,566 to Van Berkel et al.; and U.S. Publication Nos. 2012/0053065 to Van Berkel et al.; 2011/0284735 to Van Berkel et al.; 2012/0304747 to Van Berkel et al.; 2014/0096624 to ElNaggar et al.; 2013/0294971 to Van Berkel et al.; 2014/0216177 to Van Berkel et al.; and 2014/0238155 to Van Berkel et al. In addition, spatially resolved, confined liquid solid/extraction of surface has been coupled with high performance liquid chromatography (HPLC) separation utilizing a wall-less liquid microjunction probe surface sampling concept to allow transfer of the sampled material for post-sampling processing (V. Kertesz, G. J. Van Berkel. Liquid microjunction surface sampling coupled with high-pressure liquid chromatography-electrospray ionization-mass spectrometry for analysis of drugs and metabolites in whole-body thin tissue sections. *Anal. Chem.* 2010, 82, 5917-5921; V. Kertesz, G. J. Van Berkel. Automated liquid microjunction surface sampling-HPLC-MS/MS analysis of drugs and metabolites in whole-body thin tissue sections. *Bioanal.* 2013, 5, 819-826; G. J. Van Berkel, V. Kertesz. Continuous-flow liquid microjunction surface sampling probe connected on-line with high-performance liquid chromatography/mass spectrometry for spatially resolved analysis of small molecules and proteins. *Rapid Commun. Mass Spectrom.* 2013, 27, 1329-1334). The best spatial resolution achieved was about 500 μm.

Recently a single capillary liquid junction extraction/ESI emitter named scanning probe electrospray ionization (SP-ESI) was introduced for surface analysis purposes. See U.S. Pat. No. 8,710,436 to Otsuka; U.S. Publication Nos. 2014/0070088 to Otsuka; US 2013/0341279 to Otsuka et al.; 2014/0070089 to Otsuka; U.S. 2014/0070093 to Otsuka; U.S. 2014/0070094 to Otsuka; U.S. 2014/0072476 to Otsuka; and 2013/0334030 to Otsuka et al.; Otsuka et al. Imaging mass spectrometry of a mouse brain by tapping-mode scanning probe electrospray ionization. Analyst, 2014, 139, 2336-2341; and Otsuka et al.; Scanning probe electrospray ionization for ambient mass spectrometry. *Rapid Commun. Mass Spectrom.* 2012, 26, 2725-2732. This geometry eliminates the aspiration/emitter capillary that is a primary factor in the ultimate resolution of any dual capillary, liquid junction surface sampling probe. A single capillary is used to supply solvent to form a liquid junction between the capillary and a sample surface. A bias voltage is applied to the solvent to generate an ESI from liquid that pools at the top of the capillary via capillary action and the force of the applied electric field. In the version most suitable for imaging, spontaneous vibration of the probe itself (termed tapping-mode) created an alternate liquid junction surface sampling/non-contact ESI situation at a rate of greater than 100 Hz. Data presented by Otsuka and coworkers indicated a sampling spot size and lane scan width of approximately 150 μm. As surface sampling probes become smaller and direct spraying from the probe is accomplished there is a need for a way to incorporate post-sampling sample processing to obtain more chemical information. The elimination of the aspiration capillary from these systems requires a different system to handle the extract.

The disclosures of the above-identified patents and publications are incorporated fully by reference.

SUMMARY OF THE INVENTION

A system for sampling a surface includes a surface sampling probe comprising a solvent liquid supply conduit and a distal end, and a sample collector for suspending a sample collection liquid adjacent to the distal end of the surface sampling probe. A first electrode provides a first voltage to solvent liquid at the distal end of the surface sampling probe. The first voltage produces a field sufficient to generate an electrospray plume at the distal end of the surface sampling probe. A second electrode provides a second voltage. The second electrode is positioned to produce a plume-directing field sufficient to direct the components of the electrospray plume generated at the distal end of the surface sampling probe to the suspended sample collection liquid. The second voltage is less than the first voltage in absolute value. A voltage supply system supplies the voltages to the first electrode and the second electrode. The first electrode can apply the first voltage directly to the solvent liquid.

The system can further include a driver for moving the distal end of the surface sampling probe between at least a surface-adjacent position and a surface-remote position. The voltage system can supply an electrospray generating voltage to the first electrode when the surface sampling probe is in the surface-remote position, and can supply a non-electrospray generating voltage difference when the surface sampling probe is in the surface-adjacent position. The driver can oscillate the distal end of the surface sampling probe between the surface-adjacent position and the surface-remote position at between 1 Hz and 100 MHz.

The second electrode can be electrically connected to the sample collector. The second electrode can be positioned such that the second voltage is applied to the sample collection liquid. The second electrode can include electrospray plume-directing structure for directing the movement of the charged droplets and ions of the electrospray plume toward the sample collector. The second electrode can be a plate and the plume-directing structure can be an opening in the plate. The plate and the plume-directing opening can be interposed between and not connected to the sample collector and the distal end of the probe when the probe is in the surface-remote position.

The system can include at least a third electrode for providing a third voltage. The third electrode can be positioned remotely to the second electrode. The third voltage can produce a plume-directing field that is supplemental to the plume directing field of the second electrode. The second electrode can be located remotely to the sample collector and positioned at a distance from the distal end of the surface sampling probe. The third electrode can be positioned at greater distance to the distal end of the surface sampling probe. A fourth electrode can be connected to the sample collector. A plume-directing voltage can be applied to the fourth electrode.

The surface sampling probe can include a probe body having a liquid inlet and a liquid outlet, and a liquid extraction tip. A solvent delivery conduit receives solvent liquid from the liquid inlet and delivers the solvent liquid to the liquid extraction tip. An open liquid extraction channel can extend across an exterior surface of the probe body from the liquid extraction tip to the liquid outlet. An electrospray emitter tip is in liquid communication with the liquid outlet of the liquid extraction surface sampling probe.

The electrospray-generating field can be at least $10^8$ V/m. The field at the distal end of the surface sampling probe can be at least $10^8$ V/m.

The surface-adjacent position can be less than 1 mm from the sample surface. The surface-remote position can be between 1 μm and 5 cm from the sample surface.

The driver can include a mechanical relay. The driver can include a piezoelectric device. The driver can include an atomic force microscopy cantilever system.

The system can further include a pump for pumping solvent through the conduit to the surface, and for withdrawing solvent from the surface through the conduit. The sample collection liquid can be suspended statically. The sample collection liquid can be suspended dynamically. The sample collector can include a sample collection liquid suspension opening, a sample collection liquid supply conduit communicating with the suspension opening, and a sample collection liquid removal conduit communicating with the suspension opening. The rate of supply of collection liquid can be balanced with the rate of removal such that the sample collection liquid passes the suspension opening to receive charged droplets and ions from the surface sampling probe but does not exit the probe through the suspension opening, and is removed through the removal conduit.

The system can further include at least one separation device for separating samples in the sample collection liquid. The separation device can include at least one selected from the group consisting of liquid chromatography, solid phase extraction, high pressure liquid chromatography (HPLC), ultra pressure liquid chromatography (UPLC), capillary electrophoresis, ion mobility spectrometry and differential mobility spectrometry.

The system can include a mass spectrometer for analyzing samples from the sample collection liquid. The mass spectrometer can include at least one selected from the group consisting of sector MS, time-of-flight MS, quadrupole mass filter MS, three-dimensional quadrupole ion trap MS, linear quadrupole ion trap MS, Fourier transform ion cyclotron resonance MS, orbitrap MS, and toroidal ion trap MS.

A method for analyzing a surface can include the steps of providing a surface sampling probe comprising a solvent liquid supply conduit and a distal end; positioning a sample collector for suspending a sample collection liquid adjacent to the distal end of the surface sampling probe; applying a first voltage to the distal end of the surface sampling probe, the first voltage producing a field sufficient to generate an electrospray plume at the distal end of the surface sampling probe; applying a second voltage to an electrode positioned such that electrospray generated charged droplet and ions at the distal end of the surface sampling probe are directed to the suspended sample collection liquid, the second voltage being less than the first voltage (in absolute value) and sufficient to direct the electrospray plume to the sample collector; and collecting the plume components in the sample collection liquid of the sample collector.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
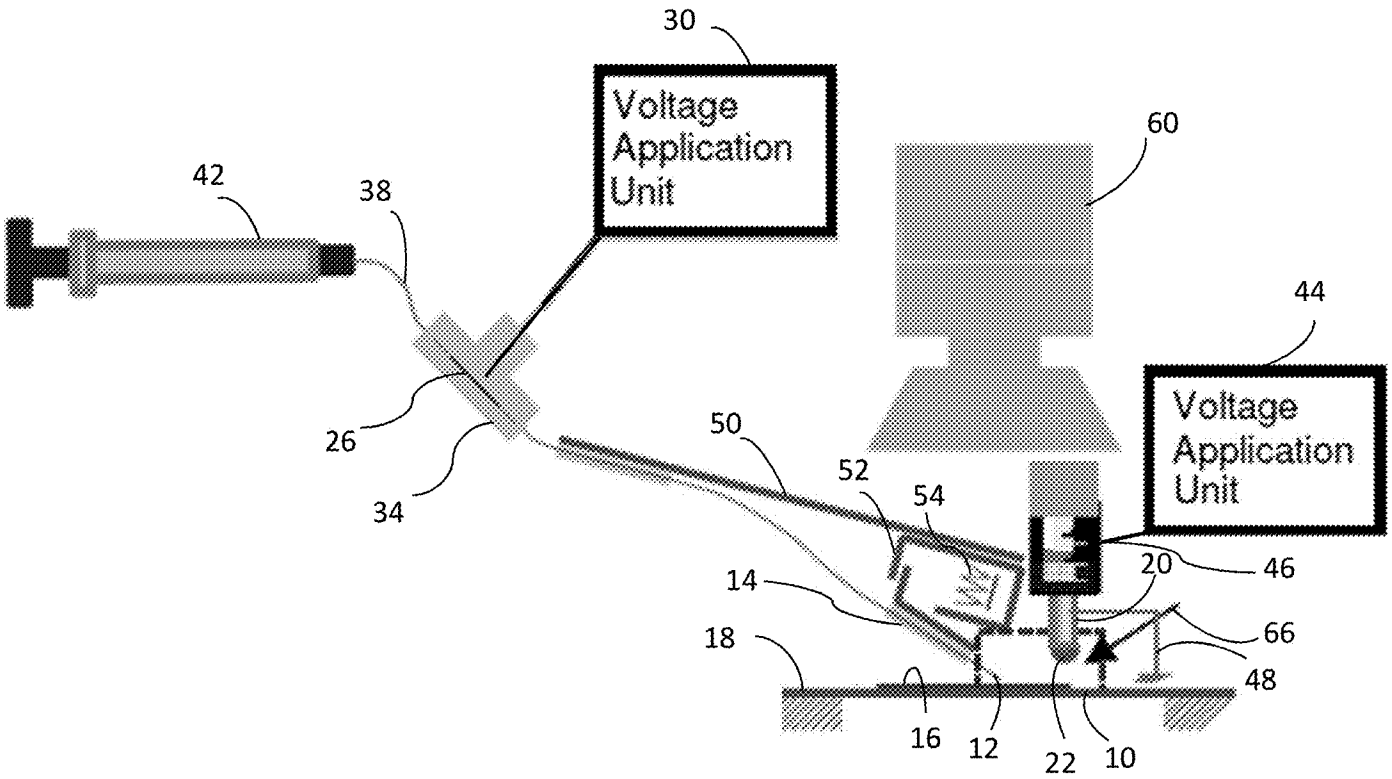
FIG. 1 is a schematic diagram of the system for sampling a surface.

A system for sampling a surface is shown in FIG. 1 which includes a surface sampling probe 14 comprising a solvent liquid supply conduit 38 and a distal end 12, and a sample collector 20 for suspending a sample collection liquid 22 adjacent to the distal end of the surface sampling probe 14. A first electrode 26 provides a first voltage to solvent liquid at the distal end of the surface sampling probe. The first voltage produces a field sufficient to generate electrospray plume at the distal end of the surface sampling probe. A second electrode 46 provides a second voltage. The second electrode 46 is positioned to produce a plume-directing field sufficient to direct electrospray plume components generated at the distal end 12 of the surface sampling probe 14 to the suspended sample collection liquid 22. The second voltage is less than the first voltage in absolute value. A voltage application unit or supply system 30 supplies the voltages to the first electrode 26 and the second electrode 46. The first electrode 26 can apply the first voltage directly to the solvent liquid or through a suitable conductive housing 34 which will electrically connect the first electrode 26 to the solvent liquid.

Solvent liquid exits the distal end 12 of the probe 14 and contacts sample 16 on support surface 18. A liquid micro-junction can be formed between the distal end 12 of the probe 14 and the sample 16. The voltage that is applied to the solvent liquid by a voltage application unit 30 is sufficient to generate an electrospray plume of the solvent liquid and sample. The position and voltage of the second electrode 46 is sufficient to direct the plume components through the space indicated by arrow 66 to the sample collection liquid 22. The position of the second electrode 46 can vary. In the example shown in FIG. 1, the second electrode 46 can communicate with a sample collection liquid 22 by a direct connection to the sample collector 20. Other arrangements are possible. The second electrode 46 can receive a voltage from the voltage application unit 30 or from a dedicated voltage application unit 44. A grounding electrode 48 can be provided. Solvent liquid can be provided to the solvent liquid supply conduit 38 through any suitable source and can have a suitable pump such as syringe 42 or a dedicated liquid solvent supply system.

The system can further include a driver for moving the distal end 12 of the surface sampling probe 14 between at least a surface-adjacent position and a surface-remote position. There is shown in FIG. 1 a mounting arm 50 for the surface sampling probe 14. A mechanical relay 52 is provided with an oscillator 54 to move the surface sampling probe 14 between surface adjacent and surface remote positions. Other drivers are possible.

The suspension of the sample collection liquid refers to the fact that the sample collection liquid is maintained out of direct contact with the sample surface or the probe. The sample collection liquid can be maintained either statically, for example suspended as a drop, or dynamically in which the sample collection liquid is flowed but is at some point available to receive charged droplets and gas phase ions from the electrospray plume and remains out of contact with the sample surface or the probe. The adjacent positioning of the sample collection liquid means that the liquid is suspended at a distance where the electrospray plume will reach the sample collection liquid without substantial dissipation of the plume into the surrounding atmosphere. The distal end of the probe refers to a portion of the probe that is nearer to the point of the probe where the solvent exits the probe than where the solvent enters the probe. The second voltage is equal to or less than the first voltage. Less can mean 1-100 V, or more, in absolute value. The term plume directing field refers to the ability of this field to steer the electrospray plume in the direction of the sample collection liquid such that the probability of the plume components contacting and being trapped in the sample collection liquid is greater than the probability would be without the field.

Figure 2A:
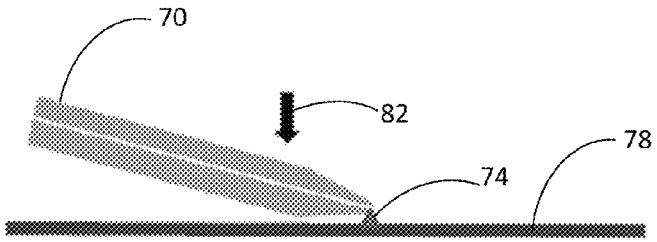
FIG. 2(*a-b*) is a schematic diagram of a second embodiment of a system for sampling a surface in a (a) first mode of operation and in a (b) second mode of operation.
Figure 2B:
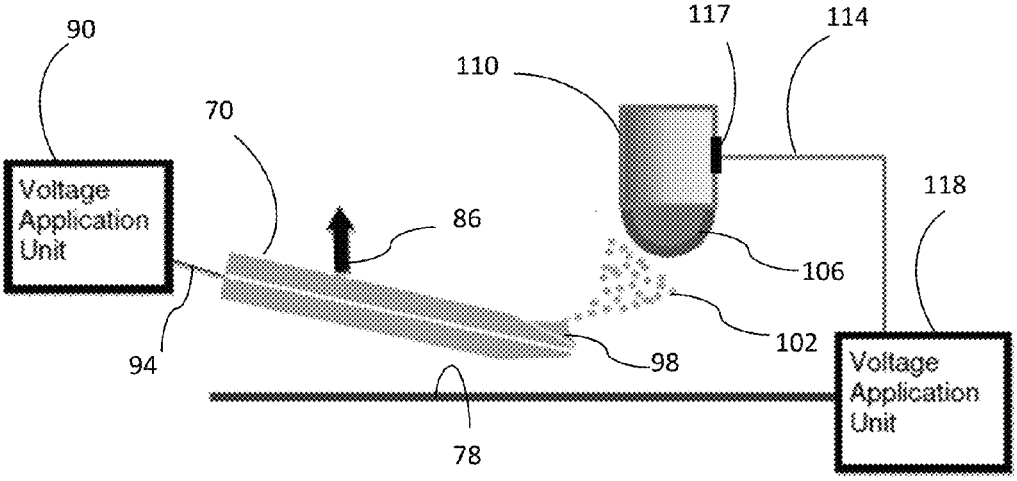

The voltage system can supply an electrospray generating voltage to the first electrode when the surface sampling probe is in the surface-remote position, and can supply a non-electrospray generating voltage when the surface sampling probe is in the surface-adjacent position. There is shown in FIG. 2(*a*) a probe 70 which is moved toward the sample surface 78 in the direction of arrow 82 to a surface-adjacent position in which solvent liquid is applied to the sample surface 78 and a liquid microjunction 74 can be formed. There is shown in FIG. 2(*b*) a second mode of operation in which the surface sampling probe 70 is moved in the direction of arrow 86 to a surface-remote position. In this position, accumulated solvent liquid 98 containing sample from the surface 78 is raised to the first voltage and is electrosprayed. A voltage application unit 90 can be provided to supply voltage to the solvent liquid, such as through an electrical connection 94. The sample collector 110 can receive a voltage from a dedicated voltage application unit 118 through an electrical connection 114 to an electrode 117. The application of the first voltage to the accumulated solvent 98 generates an electrospray plume 102 which is directed by the second voltage applied at the sample collector 110 into contact with the sample collection liquid 106. The solvent liquid can also be maintained at the first voltage instead of being cycled while the probe 70 is oscillated between the surface-adjacent and surface-remote positions. The driver can oscillate the distal end of the surface sampling probe between the surface-adjacent position and the surface-remote position at between 1 Hz and 100 MHz. The second electrode can be electrically connected to the sample collector 110, or the second electrode can be positioned such that the second voltage is applied directly to the sample collection liquid 106.

Figure 3:
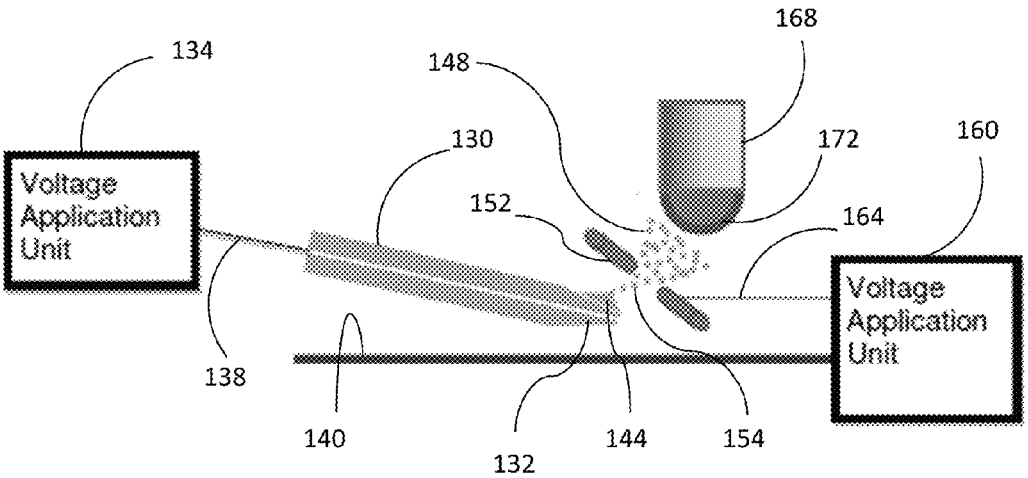
FIG. 3 is a schematic diagram of a third embodiment of a system for sampling a surface.

The second electrode can be positioned remotely from the sample collector and can direct the electrospray plume to the sample collection liquid. The second electrode can include a plume-directing structure for directing the movement of the plume components toward the sample collector. There is shown in FIG. 3 a system having a surface sampling probe 130 which receives a first voltage from the voltage application unit 134 and an electrical connection 138 such that solvent liquid at the tip 132 of the probe 130 can be raised to the first voltage. The solvent liquid is applied by the probe 130 to the sample 140 and is taken up by the probe 130 such that a combination of solvent and sample accumulates on the tip 132. The accumulated solvent and sample 144 is electrosprayed forming the electrospray plume 148 by the first voltage. The electrospray plume 148 is directed by a second, plume-directing electrode 152 that in this embodiment is not electrically connected to the sample collection liquid 172 or the sample collector 168. The second electrode 152 can be located remotely to the sample collector 168 and positioned at a distance from the distal end 132 of the surface sampling probe 130. Any suitable charged droplet or ion-directing structure is possible. The second electrode 152 can be a plate and the plume-directing structure can be an opening 154 in the plate. The second electrode 152 and the plume-directing opening 154 can be interposed between and not connected to the sample collector 168 and the distal end 132 of the probe 130 when the probe 130 is in the surface-remote position. Adjustments to the position of the second electrode 152, the size of the opening 154 and the voltage applied to the second electrode 152 can be made to control the directing of the plume 148. The second electrode 152 can receive a voltage from the voltage application unit 134, or from a dedicated voltage application unit 160 through an electrical connection 164.

Figure 4:
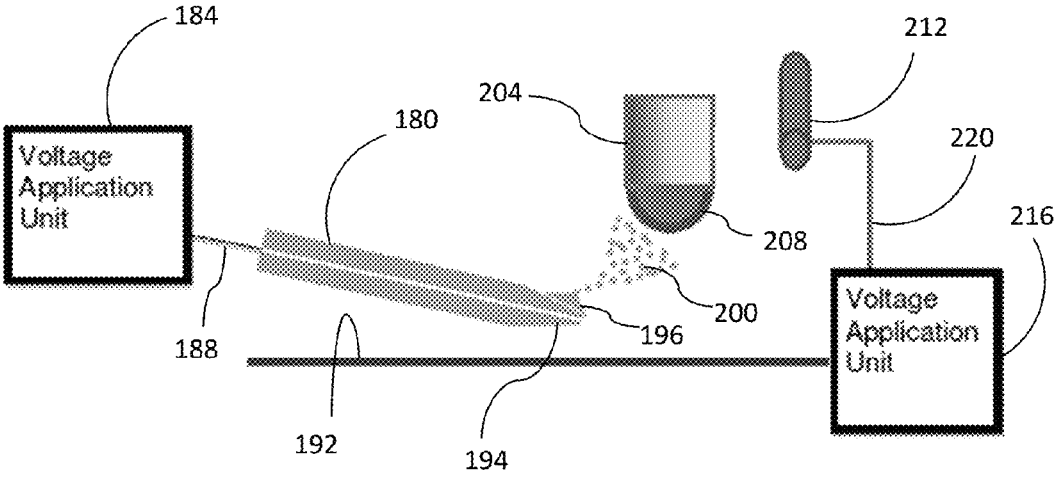
FIG. 4 is a schematic diagram of a fourth embodiment of a system for sampling a surface.

The system can include at least a third electrode for providing a third voltage, as shown in FIG. 4. A surface sampling probe 180 receives a first voltage as from a voltage application unit 184 through a suitable electrical connection 188. The voltage is applied such that solvent liquid at the tip 194 of the probe 180 is at a raised, electrospray generating voltage. The probe applies solvent liquid to the sample 192, and solvent with sample 196 accumulates at the tip 194 and is transformed by the first voltage into an electrospray plume 200. The third electrode 212 can be positioned remotely to the sample collector 204 and sample collection liquid 208, and also remotely to a second electrode if present. The third electrode 212 can be used with or without a second electrode interposed between the distal end 194 of the probe 180 and the sample collector 204. The third voltage can produce an electric field that directs the electrospray plume 200 to the sample collection liquid 208, and can be used alone or as a supplemental plume-directing field to the directing field of a second electrode, if present. The third electrode 212 can be positioned at a greater distance to the distal end 194 of the surface sampling probe than is the sample collector 204. The third electrode can receive the third voltage from the voltage application unit 184, or from a dedicated voltage application unit 216 through a suitable electrical connection 220.

Figure 5:
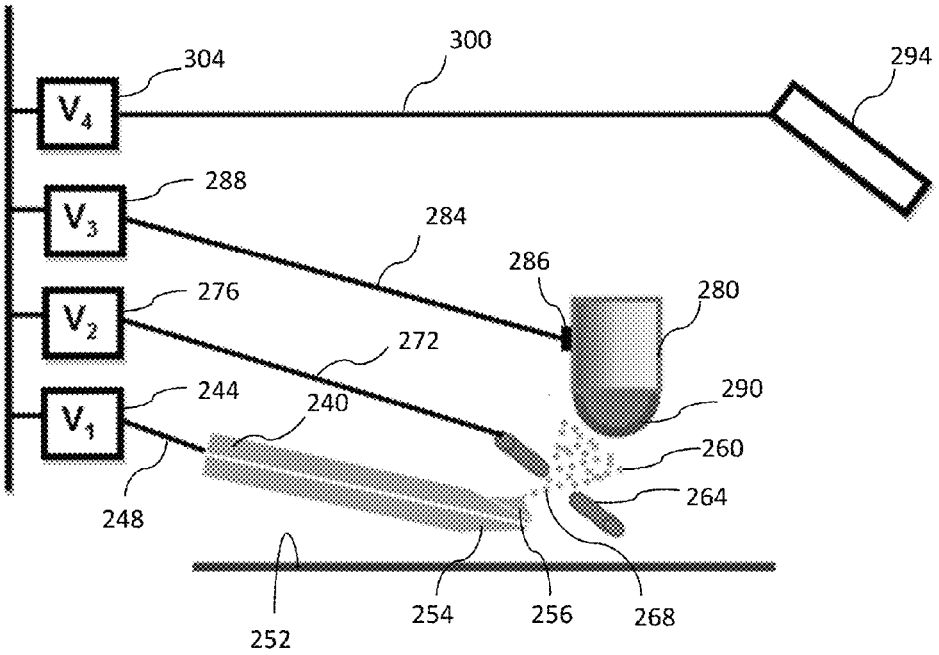
FIG. 5 is a schematic diagram of a fifth embodiment of a system for sampling a surface.

Multiple electrodes can be utilized in order to finely control the plume-generating and directing fields, and the interplay among these fields. Such a system is shown in FIG. 5. A surface sampling probe 240 applies a solvent to sample 252. The surface sampling probe 240 receives a first voltage $V_1$ from a voltage application unit 244 through a suitable electrical connection 248. The first voltage is applied to solvent at the tip 254 of the surface sampling probe 240 such that accumulated solvent and sample 256 is electrosprayed forming and electrospray plume 260. A second electrode 264 can receive a second voltage $V_2$ from a voltage application unit 276 through a suitable electrical connection 272 to create a plume-directing field to the second electrode 264, and if the second electrode has an opening 268 as shown, to direct the plume 260 through the opening 268 and to the sample collection liquid 290. A third electrode 286 connects to the sample collector 280 and receives voltage $V_3$ from voltage application unit 288 through a suitable electrical connection 284. A fourth electrode 294 can be positioned to further assist plume direction, such as with the sample collector 280 positioned between the fourth electrode 294 and the tip 254 of the probe 240. A plume-directing voltage $V_4$ can be applied to the fourth electrode 294 from voltage application unit 304 and suitable electrical connection 300.

Figure 6:
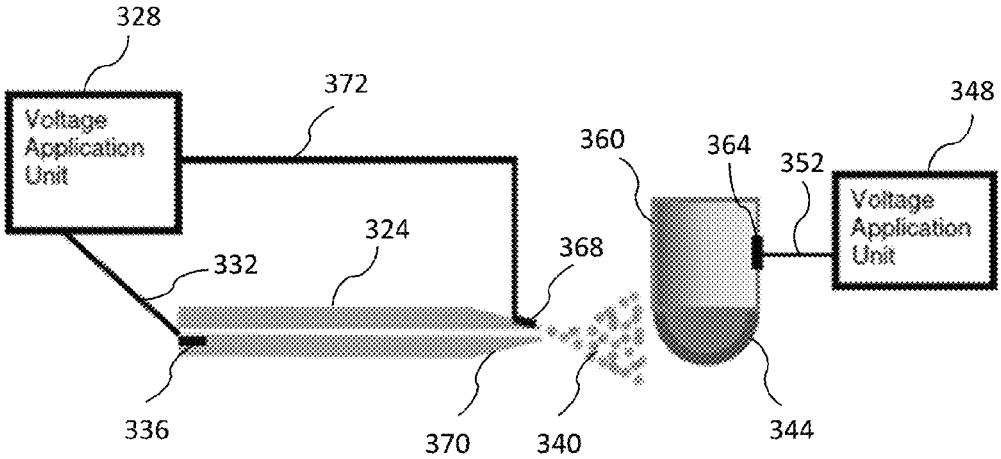
FIG. 6 is a schematic diagram of a sixth embodiment of a system for sampling a surface.
Figure 7:
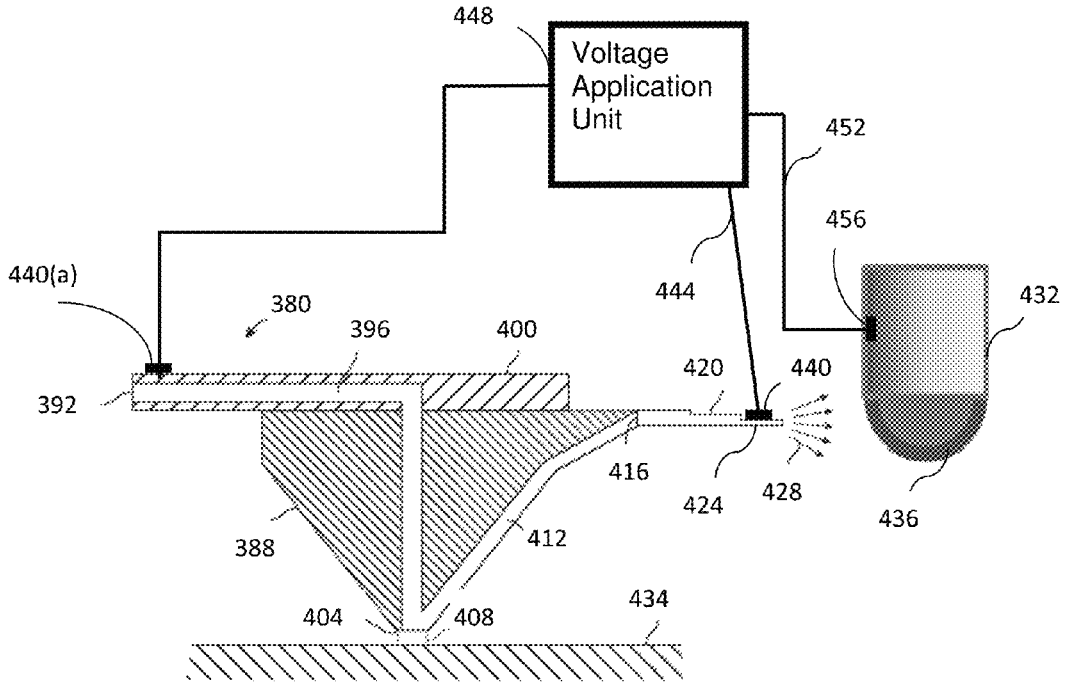
FIG. 7 is a schematic diagram of a seventh embodiment of a system for sampling a surface.

Many orientations between the sample collector and the probe are possible. One such orientation is shown in FIG. 6, where the surface sampling probe 324 receive a voltage from a voltage application unit 328 and a suitable electrical connection 332 to an electrode 336 that is capable of applying the voltage to the solvent liquid. The solvent contacts the sample and the voltage converts the solvent and sample into an electrospray plume 340. Alternative or supplemental electrode 368 can be positioned at the tip 370 and apply voltage received through electrical connection 372 from voltage application unit 328 or a dedicated voltage application unit. The plume 340 is collected in sample collection fluid 344 at sample collector 360. The sample collection fluid 344 can be at a voltage supplied by voltage application unit 348 through electrical connection 352 to the electrode 364 which either directly or indirectly applies this voltage to the collection liquid 344. The surface sampling probe 324 is shown adjacent to and at the same vertical level as the sample collection liquid 344. Other orientations are possible, and it is also possible to connect the probe 324 and/or sample collector 360 to suitable driving structure such that the relative positioning of each is adjustable There is shown in FIG. 7 an alternative embodiment in which a surface sampling probe 380 can include a probe body 388 having a liquid inlet 392 and a liquid outlet 416, and a liquid extraction tip 404. A solvent delivery conduit 396 receives solvent liquid from the liquid inlet and delivers the solvent liquid to the liquid extraction tip 404 to be applied to sample surface 434 and removed by open liquid extraction channel 412. A liquid microjunction 408 can be formed between the liquid extraction tip 404 and the sample surface 434. An open liquid extraction channel 412 extends across an exterior surface of the probe body from the liquid extraction tip 404 to the liquid outlet 416. An electrospray emitter tip 420 is in liquid communication with the liquid outlet 416 of the liquid extraction surface sampling probe 380. The tip 420 terminates in distal end 424. Solvent and sample are converted into an electrospray plume 428 at the distal end by an applied voltage and directed to sample collection liquid 436 at a sample collector 432. A voltage application unit 448 can supply a voltage to a downstream electrode 440 at the distal end 424 by a suitable electrical connection 444 and/or to an upstream electrode 440(*a*). An electrode 456 applies a voltage to the sample collection liquid 436 at the sample collector 432. The electrode 456 can receive the voltage from the voltage application unit 448 through a suitable electrical connection 452, or from a dedicated voltage application unit. The probe 380 can be mounted on a suitable mounting arm 400, for example a movable cantilever.

The electrospray plume generating field is selected for the particular solvent/analyte system and quantitative factors such as analyte concentration and distance to the sample collector. The plume generating field can be at least $10^8$ V/m. The voltage at the distal end of the surface sampling probe can be sufficient to generate a field of at least $10^8$ V/m.

The surface adjacent position can be less than 1 mm from the sample surface. The surface-remote position can be between 1 μm and 5 cm from the sample surface.

The solvent and sample collection liquid can be the same or different compositions. Examples of suitable sampling solvents include all those that can be electrosprayed, with or without additives like acids or bases or various salts, including among others methanol, ethanol, isopropanol, water, acetonitrile, and chloroforms either neat or in various combinations. Examples of suitable sample collection liquids include various combinations of the same solvents that might be used to sample the surface but also solvents not typically use with electrospray including dimethylsulfoxide (DMSO) and dimethylformamide (DMF) or even very nonpolar solvents like hexane and toluene.

The driver can include a mechanical relay. The driver can include a piezoelectric device. The driver can include an atomic force microscopy cantilever system. Other driver systems are possible.

The system can further include a pump for pumping solvent through the conduit to the surface, and for withdrawing solvent from the surface through the conduit. The sample collection liquid can be suspended statically. The sample collection liquid can be suspended dynamically. The sample collector can include a sample collection liquid suspension opening, a sample collection liquid supply conduit communicating with the suspension opening, and a sample collection liquid removal conduit communicating with the suspension opening. The rate of supply of collection liquid can be balanced with the rate of removal such that the sample collection liquid passes the suspension opening to receive charged droplets and ions from the surface sampling probe but does not exit the probe through the suspension opening and is removed through the removal conduit.

Figure 8:
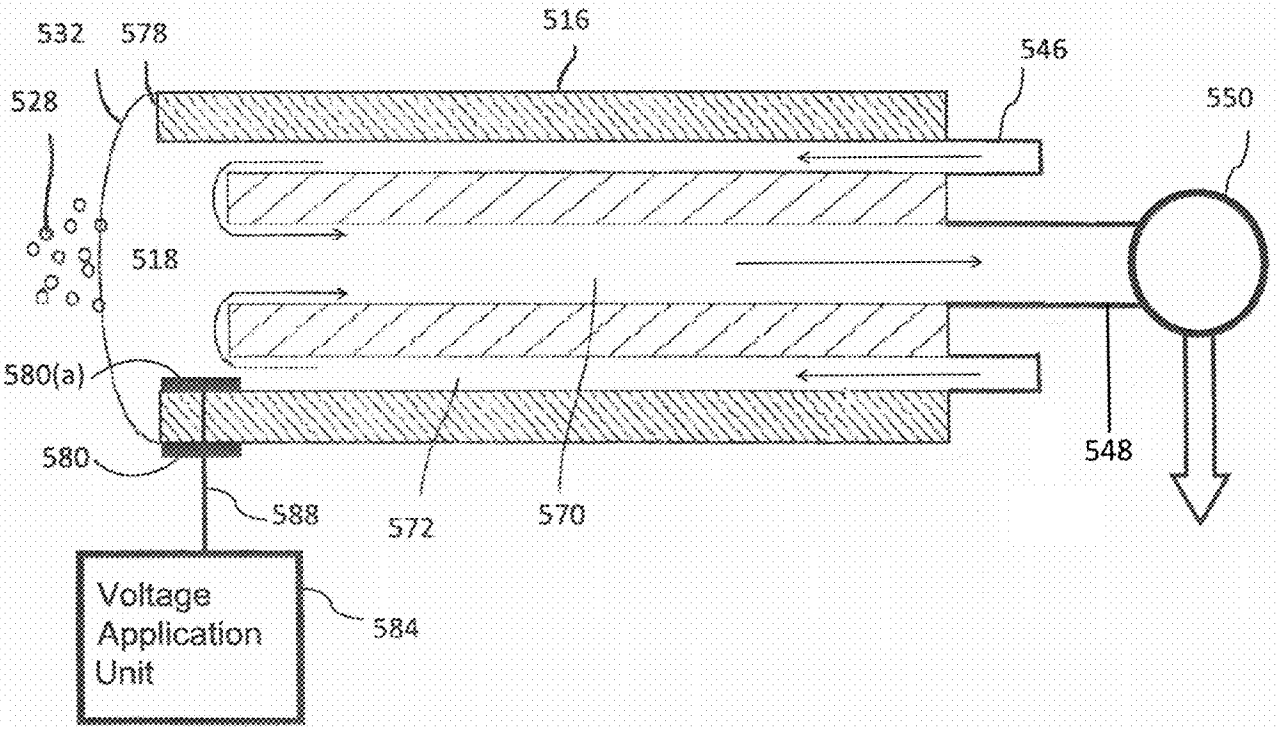
FIG. 8 is a schematic diagram of an eighth embodiment of a system for sampling a surface.

There is shown in FIG. 8 a sample collector 516 having a sample collection liquid inlet 546 and a sample collection liquid supply conduit 572 for delivering the sample collection liquid to a tip 578 of the collector 516. The sample collection liquid supply conduit 572 can be concentric with a sample collection liquid removal conduit 570 which exhausts sample collection liquid and sample through outlet 548. The supply and removal of the sample collection liquid can be balanced so as to suspend sample collection liquid 518 and form a meniscus 532 at the tip 578. A suitable pump 550 can supply and/or remove sample collection liquid. A plume 528 received from the probe (not shown) is collected at the meniscus 532 and leaves the sample collector 516 through the outlet 548 for further analysis. An exterior electrode 580 can be suitably positioned so as to apply a voltage to the sample collector and/or an interior electrode 580(*a*) can be positioned to directly apply the voltage to the sample collection liquid 518 so as to direct the plume 528 to the sample collection liquid 518. The electrodes 580 and 580(*a*) can receive the voltage from a suitable voltage application unit 584 and electrical connection 588.

The system can further include at least one separation device for separating samples in the sample collection liquid.

The separation device can include at least one selected from the group consisting of liquid chromatography, solid phase extraction, high pressure liquid chromatography (HPLC), ultra pressure liquid chromatography (UPLC), capillary electrophoresis, ion mobility spectrometry and differential mobility spectrometry.

The system can include a mass spectrometer for analyzing samples from the sample collection liquid. The mass spectrometer can include at least one selected from the group consisting of sector MS, time-of-flight MS, quadrupole mass filter MS, three-dimensional quadrupole ion trap MS, linear quadrupole ion trap MS, Fourier transform ion cyclotron resonance MS, orbitrap MS, and toroidal ion trap MS.

A method for analyzing a surface can include the steps of providing a surface sampling probe comprising a solvent liquid supply conduit and a distal end; positioning a sample collector for suspending a sample collection liquid adjacent to the distal end of the surface sampling probe; applying a first voltage at the distal end of the surface sampling probe, the first voltage producing a field sufficient to generate an electrospray at the distal end of the surface sampling probe; applying a second voltage to an electrode positioned such that electrospray plume generated at the distal end of the surface sampling probe is directed to the suspended sample collection liquid, the second voltage being less than the first voltage (in absolute value) and sufficient to direct the plume components to the sample collector; and collecting the plume components in the sample collection liquid of the sample collector.

Ranges: throughout this disclosure, various aspects of the invention can be presented in a range format. It should be understood that the description in the range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range for example, 1, 2, 2.7, 3, 4, 5, 5.3 and 6. This applies regardless of the breadth of the range.

This invention can be embodied in other forms without departing from the spirit or essential attributes thereof, and accordingly, reference should be had to the following claims to determine the scope of the invention.

We claim:

1. A system for sampling a surface, comprising:

a surface sampling probe comprising a solvent liquid supply conduit and a distal end;

a sample collector for suspending a sample collection liquid adjacent to the distal end of the surface sampling probe;

a first electrode for providing a first voltage to solvent liquid at the distal end of the surface sampling probe, the first voltage producing a field sufficient to generate an electrospray at the distal end of the surface sampling probe;

a second electrode for providing a second voltage, the second electrode being positioned to produce an electrospray plume directing field sufficient to direct electrosprayed droplets and ions at the distal end of the surface sampling probe to the suspended sample collection liquid, the second voltage being less than the first voltage in absolute value; and a voltage supply system for supplying the voltages to the first electrode and the second electrode.

2. The system of claim 1, further comprising a driver for moving the distal end of the surface sampling probe between at least a surface-adjacent position and a surface-remote position.

3. The system of claim 2, wherein the voltage system supplies an electrospray generating voltage to the first electrode when the surface sampling probe is in the surface-remote position, and for supplying a non-electrospray generating voltage difference when the surface sampling probe is in the surface-adjacent position.

4. The system of claim 2, wherein the driver oscillates the distal end of the surface sampling probe between the surface-adjacent position and the surface-remote position at between 1 Hz and 100 MHz.

5. The system of claim 1, wherein the second electrode is electrically connected to the sample collector.

6. The system of claim 1, wherein the second electrode is positioned such that the second voltage is applied to the sample collection liquid.

7. The system of claim 2, wherein the second electrode comprises a plume-directing structure for directing the movement of the charged droplets and ions toward the sample collector.

8. The system of claim 7, wherein the second electrode is a plate and the plume-directing structure is an opening in the plate, and wherein the plate and the plume-directing opening are interposed between and not connected to the sample collector and the distal end of the probe when the probe is in the surface-remote position.

9. The system of claim 1, wherein the first electrode applies the first voltage directly to the solvent liquid.

10. The system of claim 1, further comprising at least a third electrode for providing a third voltage, the third electrode being positioned remotely to the second electrode, the third voltage producing a plume-directing field that is supplemental to the plume-directing field of the second electrode.

11. The system of claim 10, wherein the second electrode is located remotely to the sample collector and positioned at a distance from the distal end of the surface sampling probe, and the third electrode is positioned at greater distance to the distal end of the surface sampling probe.

12. The system of claim 11, wherein a fourth electrode is connected to the sample collector, and a plume-directing voltage is applied to the fourth electrode.

13. The system of claim 1, wherein the surface sampling probe comprises a probe body having a liquid inlet and a liquid outlet, and having a liquid extraction tip, a solvent delivery conduit for receiving solvent liquid from the liquid inlet and delivering the solvent liquid to the liquid extraction tip, and an open liquid extraction channel extending across an exterior surface of the probe body from the liquid extraction tip to the liquid outlet; and an electrospray emitter tip in liquid communication with the liquid outlet of the liquid extraction surface sampling probe.

14. The system of claim 1, wherein the electrospray-generating field is at least $10^8$ V/m.

15. The system of claim 1, wherein the field at the distal end of the surface sampling probe is at least $10^8$ V/m.

16. The system of claim 2, wherein the surface adjacent position is less than 1 mm from the sample surface.

17. The system of claim 2, wherein the surface-remote position is between 1 μm and 5 cm from the sample surface.

18. The system of claim 2, wherein the driver comprises a mechanical relay.

19. The system of claim 2, wherein the driver comprises a piezoelectric device.

20. The system of claim 2, wherein the driver comprises an atomic force microscopy cantilever system.

21. The system of claim 1, further comprising a pump for pumping solvent through the solvent liquid supply conduit to the surface, and for withdrawing solvent from the surface through the conduit.

22. The system of claim 1, wherein the sample collection liquid is suspended statically.

23. The system of claim 1, wherein the sample collection liquid is suspended dynamically.

24. The system of claim 23, wherein the sample collector comprises:

a sample collection liquid suspension opening;

a sample collection liquid supply conduit communicating with the suspension opening; and a sample collection liquid removal conduit communicating with the suspension opening, wherein the sample collection liquid suspension opening, the sample collection liquid supply conduit, and the sample collection liquid removal conduit are sized to allow a rate of supply of collection liquid to be balanced with a rate of removal such that the sample collection liquid passes the suspension opening to receive charged droplets and ions from the surface sampling probe but does not exit the probe through the suspension opening and is removed through the removal conduit.

25. The system of claim 1, further comprising at least one separation device for separating samples in the sample collection liquid.

26. The system of claim 25, wherein the separation device comprises at least one selected from the group consisting of liquid chromatography, solid phase extraction, high pressure liquid chromatography (HPLC), ultra pressure liquid chromatography (UPLC), capillary electrophoresis, ion mobility spectrometry and differential mobility spectrometry.

27. The system of claim 1, further comprising a mass spectrometer for analyzing samples from the sample collection liquid, the mass spectrometer being at least one selected from the group consisting of sector MS, time-of-flight MS, quadrupole mass filter MS, three-dimensional quadrupole ion trap MS, linear quadrupole ion trap MS, Fourier transform ion cyclotron resonance MS, orbitrap MS, and toroidal ion trap MS.

28. A method for analyzing a surface, comprising the steps of:

providing a surface sampling probe comprising a solvent liquid supply conduit and a distal end;

positioning a sample collector for suspending a sample collection liquid adjacent to the distal end of the surface sampling probe;

applying a first voltage to the distal end of the surface sampling probe, the first voltage producing a field sufficient to generate an electrospray at the distal end of the surface sampling probe;

applying a second voltage to an electrode positioned such that electrospray plume generated at the distal end of the surface sampling probe is directed to the suspended sample collection liquid, a second absolute value of the second voltage being less than a first absolute value of the first voltage and sufficient to direct the charged droplets and ions to the sample collector; and collecting the charged droplets and ions in the sample collection liquid of the sample collector.

* * * * *